US006322202B1

(12) United States Patent
Ahn

(10) Patent No.: US 6,322,202 B1
(45) Date of Patent: Nov. 27, 2001

(54) HEATING APPARATUS FOR MICRO INJECTING DEVICE AND METHOD FOR FABRICATING THE SAME

(75) Inventor: Byung-Sun Ahn, Suwon (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/173,172

(22) Filed: Oct. 15, 1998

(30) Foreign Application Priority Data

Oct. 15, 1997 (KR) ..... 97/52821

(51) Int. Cl.[7] ..... B41J 2/05

(52) U.S. Cl. ..... 347/65; 347/54; 347/63; 216/27

(58) Field of Search ..... 347/62, 63, 64, 347/65, 54, 56, 58, 200, 208, 209; 216/27; 29/890.1; 257/736; 438/21

(56) References Cited

U.S. PATENT DOCUMENTS 3,924,974 * 12/1975 Fischbeck et al. ..... 417/322
4,480,259 * 10/1984 Kruger et al. ..... 347/63
4,513,298 * 4/1985 Scheu ..... 347/64
4,532,530 * 7/1985 Hawkins ..... 347/62
4,907,015 * 3/1990 Kaneko et al. ..... 347/204
4,914,562 * 4/1990 Abe et al. ..... 347/63
5,057,186 * 10/1991 Chew et al. ..... 216/17
5,206,659 * 4/1993 Sakuri et al. ..... 347/62
5,223,855 6/1993 Ota et al. ..... 347/209
5,368,582 * 11/1994 Bertera ..... 604/295
5,483,270 * 1/1996 Watanabe ..... 347/56
5,926,739 * 7/1999 Rolfson et al. ..... 438/763
6,074,043 * 6/2000 Ahn ..... 347/54

FOREIGN PATENT DOCUMENTS

3265101 * 11/1991 (JP) ..... 338/25

* cited by examiner

*Primary Examiner*—John Barlow
*Assistant Examiner*—Blaise Mouttet
(74) *Attorney, Agent, or Firm*—Robert E. Bushnell, Esq.

(57) ABSTRACT

A heating apparatus for a microinjection device and a method for fabricating the same, wherein an adhesion layer for improving adhesive force is included between a heater resistor layer and the electrode which supplies electricity to the heater resistor layer. This apparatus shows improved performance and lifespan over other heating apparatuses.

38 Claims, 5 Drawing Sheets

HEATING APPARATUS FOR MICRO INJECTING DEVICE AND METHOD FOR FABRICATING THE SAME

This application makes reference to, incorporates the same herein, and claims all benefits accruing under 35 U.S.C. §119 from an application for HEATING APPARATUS FOR MICRO INJECTING DEVICE AND METHOD FOR FABRICATING THE SAME earlier filed in the Korean Industrial Property Office on Oct. 15 th of 1997 and there duly assigned Ser. No. 52821/1997.

BACKGROUND OF THE INVENTION

1. Field of the Invention

The present invention relates to the field of heating apparatuses for microdevices, the method of fabricating such heating apparatuses and their methods of use, and more particularly to processes, structures and materials for the construction and use of ink-jet print heads, other microinjection devices, microelectromechanical devices and chemical analysis devices.

2. Description of the Related Art

A very common device in use today is the ink-jet print head. Ink-jet printers are superior to dot matrix printers, being able to print in multiple colors, with less noise and with better print quality.

The thermal ink-jet print head is a specific example of a structure that is representative of the class of microinjection devices, which are devices which expel small, controlled amounts of a liquid, thereby injecting the liquid into the target. In general, the ink-jet print head has a plurality of discrete micro-injectors, formed in an array, each with an orifice, or nozzle, of small diameter. Upon receiving an electrical signal, the electricity is used to heat a liquid to expand or vaporize it, expelling ink through the nozzle and onto the paper.

An exemplary ink-jet print head generally contains a heater section in which a heater resistor layer is formed on a substrate and an electrode layer is formed on the heater resistor layer to provide electrical contact. This heater section heats a working fluid which vaporizes, expanding a membrane which drives the expulsion of an ink drop. I have noticed that this ink-jet printer head design, however, is subject to several problems. First, the heater resistor layer and electrode layer are generally made of different materials, and adhesion between these layers can be weak. Chemical reactions occurring in the etching process used to pattern the layers can lead to gradual deterioration of the adhesion zone between the two layers. As a result, a gap can form between the layers. Secondly, during use, the working liquid contacting these layers may seep into the gap between the two layers, causing further deterioration. Thirdly, the mechanical stress caused by the vibration of the membrane can also cause deterioration of the contact between the layers. When such a gap forms, it leads to irregularities in the vapor pressure of the working liquid. This in turn causes irregularities in the vibration of the membrane and leads to poor formation of the ink drop and thus poor performance of the print head.

An example of earlier efforts to address a related problem is U.S. Pat. No. 5,223,855, to Ota et al., entitled Thermal Head For A Printer. This deals with the deformation of a thermal head due to the difference in thermal expansion between members and describes use of a soft adhesive to adhere the substrate containing the heating elements to a support board. This use of adhesive does not solve, however, the problem of adhesion of the electrodes to the heating resistor.

I have observed that what is needed, then, is a method for insuring that the adhesion of the electrodes to the heater resistor is robust, and has a long lifetime in devices such as ink-jet print heads.

SUMMARY OF THE INVENTION

It is therefore an object of the present invention to provide an improved heating apparatus and process for fabricating and using a heating apparatus to be used in microinjection devices.

It is a further object of the invention to provide a heating apparatus with a heater resistor layer and electrode layer that are firmly adhered together so that the heater resistor layer and the electrode layer resist separation.

It is a still further object to prevent gap formation between the electrode layer and heater resistor layer in heating devices, thereby creating more robust and longer lived devices It is a yet further object to provide an improved microinjection device incorporating the heating apparatus of the present invention.

It is a still yet further object to provide a method of manufacture of the heating apparatus of the present invention that yields an improved heating apparatus which is more robust and longer-lived.

It is another object to provide methods of use of the heating apparatus of the present invention to yield improved devices for microinjection of liquids, improved micromechanical devices, and improved devices for chemical analysis.

These and other objects may be attained with the use of a separate adhesion layer disposed between a heater resistor layer and an electrode layer during fabrication of microinjection devices. According to one aspect of the present invention, there is provided a heating apparatus for a microinjection device having a substrate with a protection film; a heater resistor layer formed on the protection film; an electrode layer formed on the heater resistor layer with an electrode pad delivering electrical energy applied from an external device; an adhesion layer inserted between the heater resistor layer and electrode layer; and a heater chamber barrier layer formed on the electrode layer to define a heater chamber that contacts the heater resistor layer. Preferably, the heater resistor layer is made of $TiB_2$, and the adhesion layer is made of vanadium, chromium, or nickel.

According to another aspect of the present invention, there is provided a method for fabricating a heating apparatus for a microinjection device by forming a protection film on a substrate and forming a heater resistor layer on the protection film; depositing an adhesion layer on the heater resistor layer; depositing a first electrode as a layer on the adhesion layer; depositing a second electrode as a layer on the first electrode; forming an electrode pad on the second electrode, and etching and patterning the adhesion layer, the first electrode and the second electrode. A heater chamber barrier layer is formed on the second electrode and the heater chamber barrier layer is patterned to form a heater chamber on the heater resistor layer.

Preferably, the adhesion layer is deposited by a sputtering method and has a thickness within the range of approximately 0.1 $\mu$m to 0.2 $\mu$m, and more preferably about 0.15 $\mu$m, and a surface resistance within the range of approximately 180 $\Omega/cm^2$ to 220 $\Omega/cm^2$, and more preferably about 200 $\Omega/cm^2$. Preferably, the electrode pad is formed into a thickness within the range of approximately 0.4 $\mu$m to 0.8

μm, and more preferably about 0.6 μm. Preferably, the heater chamber barrier layer is formed into a thickness within the range of approximately 10 μm to 15 μm, and more preferably about 13 μm. Here, it is preferable to pattern the heater chamber barrier layer by an ion-plasma etching method.

Preferably, a photoresist adhesion layer is further formed on the heater chamber barrier layer so as to promote adhesion with respect to photoresist, (colloquially referred to as PR). It is preferable to form the photoresist adhesion layer as a single layer consisting of either chromium or copper, or a layer in which chromium and copper are deposited in turn. The photoresist adhesion layer so formed has a thickness within the range of approximately 1.5 μm to 3 μm, more preferably about 2 μm. Preferably, the above-described photoresist adhesion layer is etched by a chemical etching method.

In another aspect of the present invention, there is provided a microinjection device incorporating the heating apparatus of the present invention, fabricated with a substrate having a protection film; a heater resistor layer formed on the protection film; an adhesion layer to promote adhesion between the heater resistor layer and an electrode layer; an electrode layer which contacts the heater resistor layer so as to transmit an electrical signal; a heater chamber barrier layer formed on the electrode layer so as to define a heater chamber which contacts the heater resistor layer; a flexible membrane formed on the heater chamber barrier layer so as to vibrate according to the change in volume of liquid contained in the heater chamber; and an ink chamber barrier layer formed on the membrane so as to define an ink chamber which contacts the membrane. A nozzle plate may be formed on the ink chamber barrier layer so as to define a nozzle which contacts the ink chamber. Such a device may operate using a working fluid which is different from the ink, in other words, as a two-fluid device.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those having skill in the art. As used in this description, the term "adhesion" is used generally to indicate the lack of tendency for two layers to separate from each other or for the boundary between the two layers to degrade.

Figure 1:
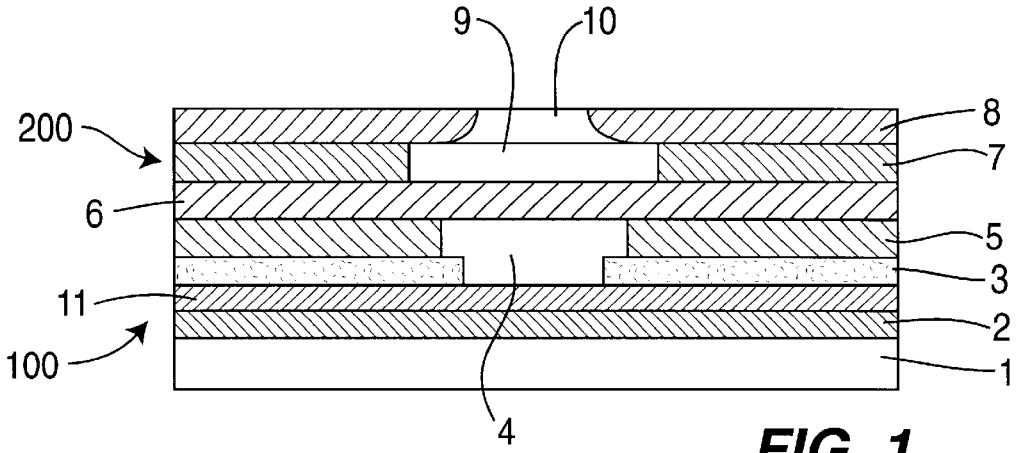
FIG. 1 is a schematic cross-sectional elevational view showing an ink-jet print head.

Turning now to the drawings, FIG. 1 is a schematic section view showing an ink-jet print head. This ink-jet print head consists of heater section 100 and injector section 200. Heater section 100 is formed below membrane 6, which is a flexible membrane, and delivers thermal energy to membrane 6, thereby causing a change in shape of membrane 6. Injector section 200 is formed on membrane 6 and ink droplets are injected due to the movement of membrane 6.

Heater section 100 in FIG. 1 operates as follows. Heater resistor layer 11 which is made of TaAl is formed on protection film 2 of supporting substrate 1. Heater resistor layer 11 so formed is provided with electrical energy from an external device through electrode layer 3 made of aluminum or nickel and which is formed on heater resistor layer 11. Electrode layer 3 is patterned by a conventional etching process. Heater resistor layer 11 converts the electrical energy provided from electrode layer 3 into thermal energy at a temperature of 500C–550C, and thus delivers the thermal energy to heater chamber 4 which is defined by electrode layer 3 and heater chamber barrier layer 5.

Heater chamber 4 is filled with an easily vaporized working liquid (not shown). The working liquid is rapidly vaporized by the heat delivered from heater resistor layer 11, and the vapor pressure generated is delivered to membrane 6. Membrane 6 is uniformly formed of materials which can undergo rapid volume change, e.g., nickel, and it expands rapidly due to the delivered vapor pressure, and is flexed into a round-shape. The flexing of membrane 6 affects injector section 200 formed thereon.

Operation of injector section 200 may be explained as follows. Through its shape transformation, membrane 6 expands toward ink chamber 9 which is formed on membrane 6 and whose walls are defined by ink chamber barrier layer 7. At this time, ink chamber 9 is filled with a certain amount of ink which then is shocked by the expansion of membrane 6 and thus forms bubbles and drops are ejected. Then, the ink passes through nozzle 10 surrounded by nozzle plate 8 and is discharged rapidly toward an external sheet of paper, thereby printing.

Figure 2:
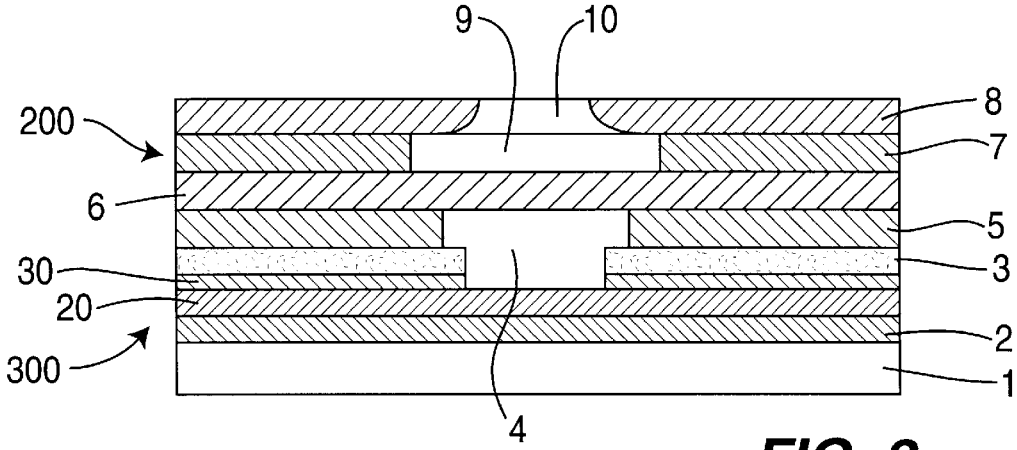
FIG. 2 is a schematic cross-sectional elevational view showing a microinjection device incorporating the heating apparatus of the present invention.

FIG. 2 is a schematic section view showing a microinjection device incorporating a heating apparatus of the present invention. In the device, substrate 1 has protective film 2 formed on it. Heater resistor layer 20 is formed on protective film 2, and adhesion layer 30 is formed on heater resistor layer 20, with the exposed surface of heater resistor layer 20 defining the bottom of heating chamber 4. Electrode layer 3 is formed on adhesion layer 30. The purpose of adhesion layer 30 is to promote adhesion between heater resistor layer 20 and electrode layer 3. Accordingly, electrode layer 3 is not stripped away from heater resistor layer 20 even when an etching process is used for patterning electrode layer 3, and this arrangement prevents formation of a gap between these layers.

Heating chamber barrier layer 5 is formed on electrode layer 3, thereby defining the walls of heating chamber 4. Membrane 6 is formed on heating chamber barrier layer 5 and spans the top of heating chamber 4. Ink chamber barrier layer 7 is formed on membrane 6, defining the walls of ink chamber 9, and nozzle plate 8 containing nozzle 10 is formed on ink chamber barrier layer 7. It is through nozzle 10 that ink is ejected from ink chamber 9.

Figure 3:
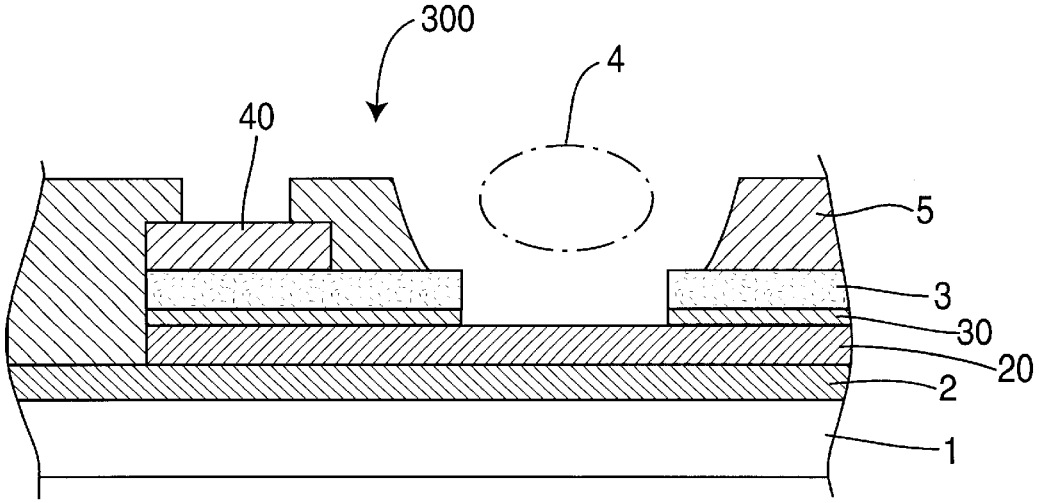
FIG. 3 is a schematic cross-sectional elevational view showing a heating apparatus of the present invention.

FIG. 3 details heater section 300 of a microinjection device of the present invention. Heater section 300 includes substrate 1 having protective or protection film 2, heater resistor layer 20 formed on the protective or protection film 2, electrode layer 3 formed on heater resistor layer 20 so as to deliver an electrical energy, electrode pad 40 formed on electrode layer 3 so as to receive and deliver an electrical energy applied from an external device, adhesion layer 30 formed between heater resistor layer 20 and electrode layer 3, and heater chamber barrier layer 5 formed on electrode layer 3 so as to define heater chamber 4 which contacts heater resistor layer 20.

In heater section 300 of a microinjection device of the present invention, electrical energy provided from an external power source is delivered to electrode pad 40 and is then delivered to heater resistor layer 20 via electrode 3 formed below electrode pad 40. Then, heater resistor layer 20 converts the above-mentioned electrical energy into thermal energy and delivers the converted electrical energy to heater chamber 4 formed thereon. Accordingly, working liquid contained in heater chamber 4 is rapidly vaporized so as to generate the desired vapor pressure.

Here, according to the characteristics of the present invention, heater resistor layer 20 is made of $TiB_2$. Heater resistor layer 20 maintains excellent adhesion with adhesion layer 30 which will be described later. In the device of FIG. 1, electrode layer 3 may be made of material, for example, aluminum or nickel, which is different from that of heater resistor layer 11. Therefore, a gap is formed on the boundary surface of the two layers during etching during manufacture or when membrane vibration occurs.

In the present invention, however, as shown in FIG. 2, adhesion layer 30 maintains excellent adhesion between heater resistor layer 20 and electrode layer 3 to thereby prevent possible formation of the above-described gap. According to the present invention, adhesion layer 30 may be made of vanadium, nickel, or chromium, which provide excellent adhesion with $TiB_2$ of heater resistor layer 20 and with the aluminum or nickel of electrode layer 3.

Figure 4:
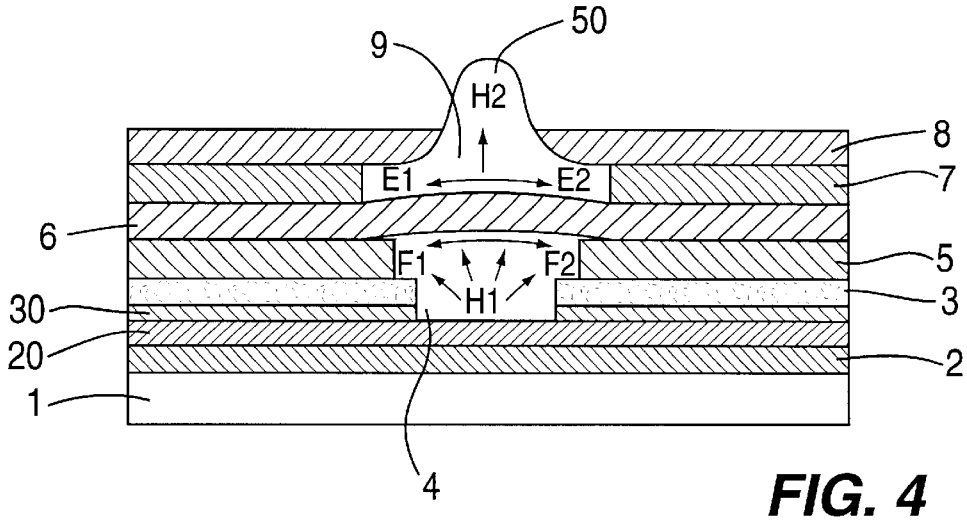
FIGS. 4 through 9 are schematic cross-sectional elevational views showing an operation of a microinjection device incorporating a heating apparatus constructed according to the principles of the present invention.

FIGS. 4 through 9 are schematic section views showing the operation of the microinjection device of FIG. 2, which incorporates a heating apparatus of the present invention. As shown in FIG. 4, the electrical signal from electrode layer 3 is transmitted to heater resistor layer 20, converted to thermal energy, and delivered to heater chamber 4. Then, working liquid stored in heater chamber 4 is vaporized so as to generate a desired vapor pressure.

Figure 5:
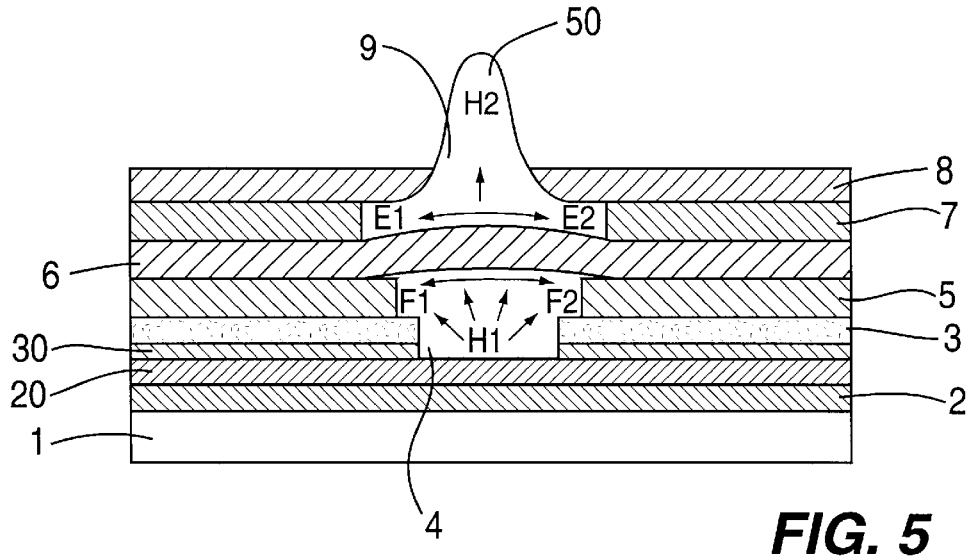
Figure 6:
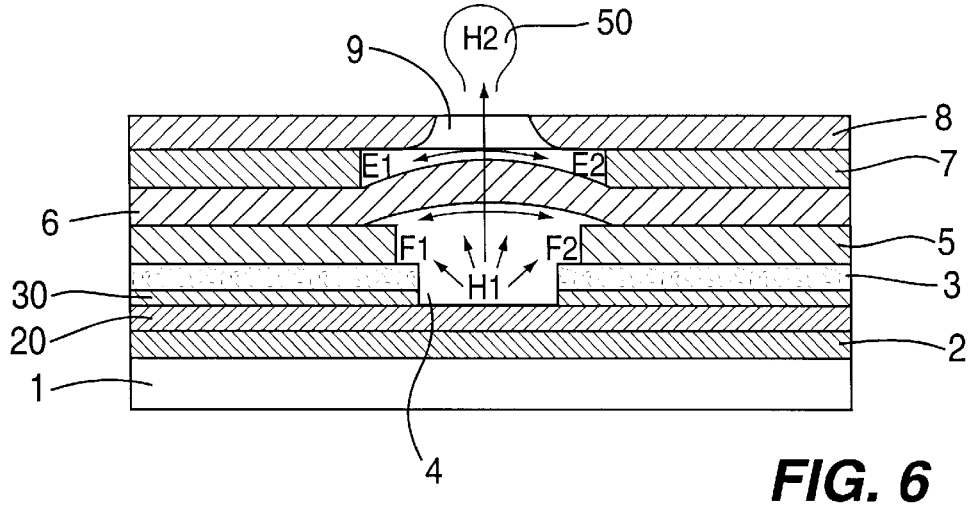

Membrane 6 formed on heater chamber 4 is expanded by the vapor pressure so generated. As a result, ink 50 contained in ink chamber 9 forms a vapor bubble. Here, as shown in FIGS. 4 and 5, the vapor pressure moves in vertical direction (H1–H2) with respect to membrane 6 in accordance with the vaporization of working liquid, and membrane 6 expands in a horizontal direction (E1–E2, F1–F2). Thus, as shown in FIG. 6, ink 50 is about to be injected.

Thus one object of the present invention is achieved in that adhesion layer 30, formed between heater resistor layer 20 and electrode layer 3, serves to prevent a gap from being generated due to weak structure between the two layers. As a result, working liquid in heater chamber 4 does not seep between the layers, and this cause of loss of lifetime of the apparatus is eliminated. This thus allows for controlled generation of the vapor pressure of the working liquid delivered from heater chamber 4 to membrane 6, and membrane 6 can vibrate appropriately. Accordingly, the drop of ink 50 discharged to an external printing paper can be uniformly formed. As a result, significant improvement in the quality of printing can be obtained.

Figure 7:
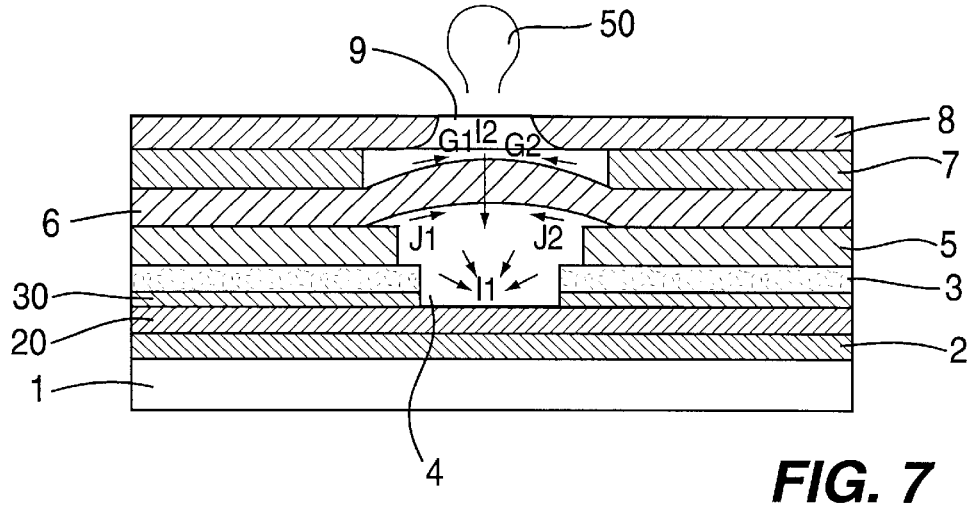
Figure 8:
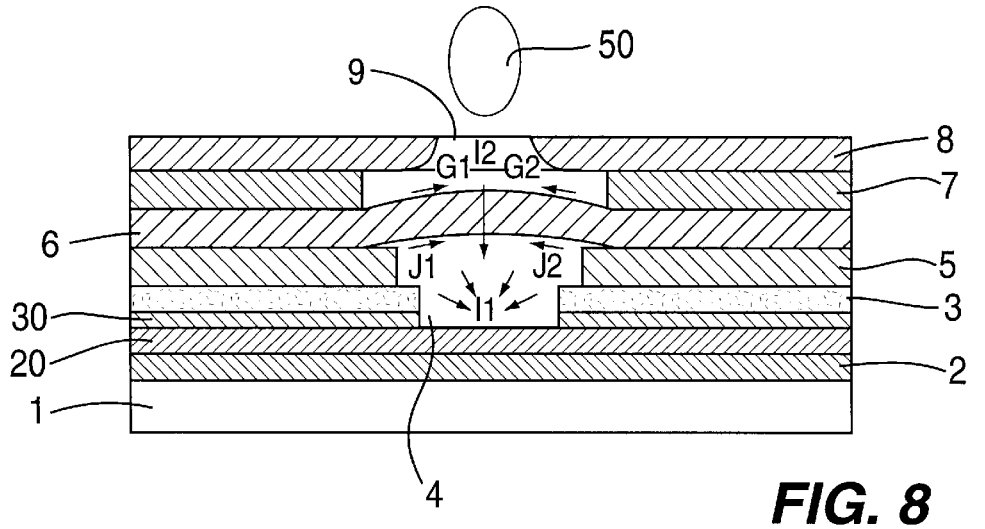
Figure 9:
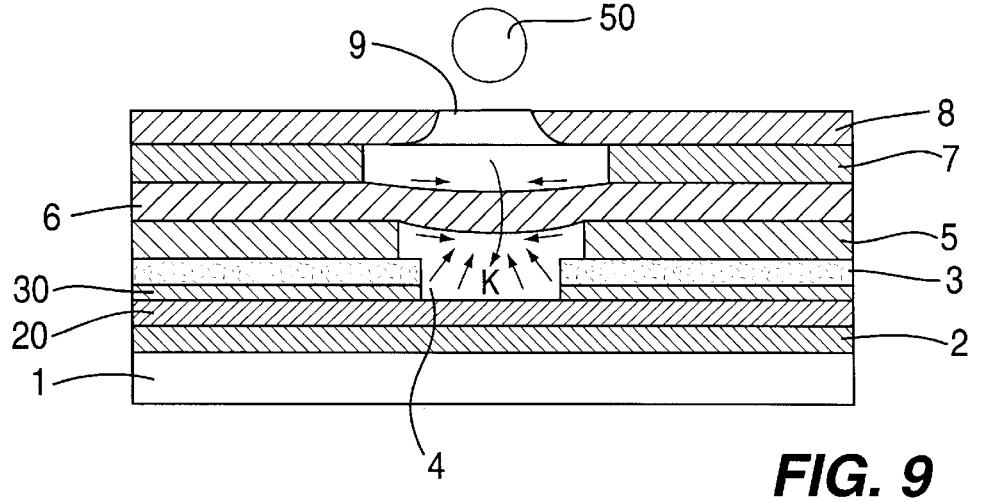

As the electrical signal from electrode layer 3 is cut off, membrane 6 contracts in the horizontal direction (G1–G2, J1–J2) as shown in FIGS. 7, 8 and 9. In ink chamber 9 and heater chamber 4, contraction (I1–I2) and buckling power (indicated as "K") are generated. At this time, a strong adhesive force is maintained between heater resistor layer 20 and electrode layer 3 via adhesion layer 30 of the present invention. Formation of a gap is prevented even if the above-mentioned contraction and buckling power affect the boundary surface between heater resistor layer 20 and electrode 3 via heater chamber 4. The ejection of ink onto paper is completed, as shown in FIGS. 8 and 9, as membrane 6 is buckled downward, and ink 50 is transformed into an oval or circular drop by surface tension.

Turning now to the method of fabricating a heating apparatus of the present invention, FIGS. 10A to 10G are cross-sectional views sequentially showing such a method. As shown in FIGS. 10A to 10G, a method of the present invention includes steps of forming protective or protection film 2 on substrate 1 and forming heater resistor layer 20 onto protective or protection film 2; depositing adhesion layer 30 onto heater resistor layer 20; depositing first electrode 3*a*, formed as a layer, on adhesion layer 30; depositing second electrode 3*b*, formed as a layer without contacting adhesion layer 30, on first electrode 3*a*; forming electrode pad 40 on second electrode 3*b*; etching and patterning adhesion layer 30 and first and second electrodes 3*a* and 3*b*; and forming heater chamber barrier layer 5 on second electrode 3*b* and patterning heater chamber barrier layer 5 so as to form heater chamber 4 on heater resistor layer 20.

Figure 10A:
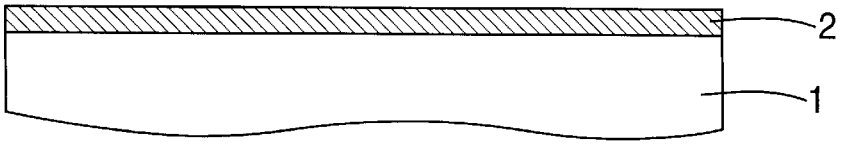
FIGS. 10A through 10G are cross-sectional elevational views sequentially showing a method of fabricating a heating apparatus according to the principles of the present invention.
Figure 10B:
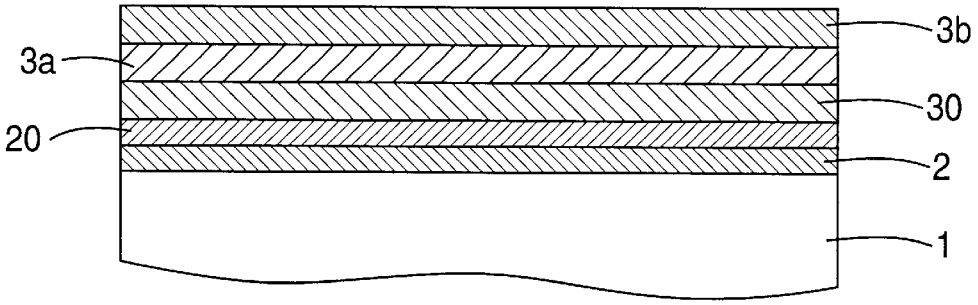

Now, each step of the method of the present invention will be explained in more detail. As shown in FIG. 10A, protection or protective film 2 is formed on substrate 1, substrate 1 being made of silicon, so as to protect substrate 1. Protection or protective film 2 so formed is made of $SiO_2$. As shown in FIG. 10B, heater resistor layer 20 made of $TiB_2$ is deposited on protection film 2.

Then, adhesion layer 30, made of vanadium, chromium or nickel, is deposited on heater resistor layer 20. Here, according to the characteristics of the present invention, adhesion layer 30 is deposited by a sputtering method. Therefore, adhesion layer 30 is deposited uniformly on heater resistor layer 20. Preferably, adhesion layer 30 is formed to a thickness within a range of approximately 0.1 $\mu$m to 0.2 $\mu$m, and more preferably about 0.15 $\mu$m, and has a surface resistance within the range of approximately 180 $\Omega/cm^2$ to 220 $\Omega/cm^2$, and more preferably about 200 $\Omega/cm^2$. Then, first electrode 3*a* made of aluminum and second electrode 3*b* made of nickel are deposited on adhesion layer 30.

Figure 10C:
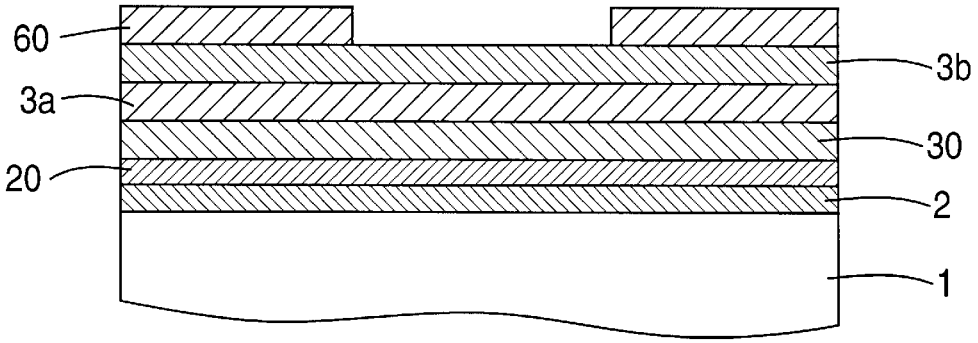
Figure 10D:
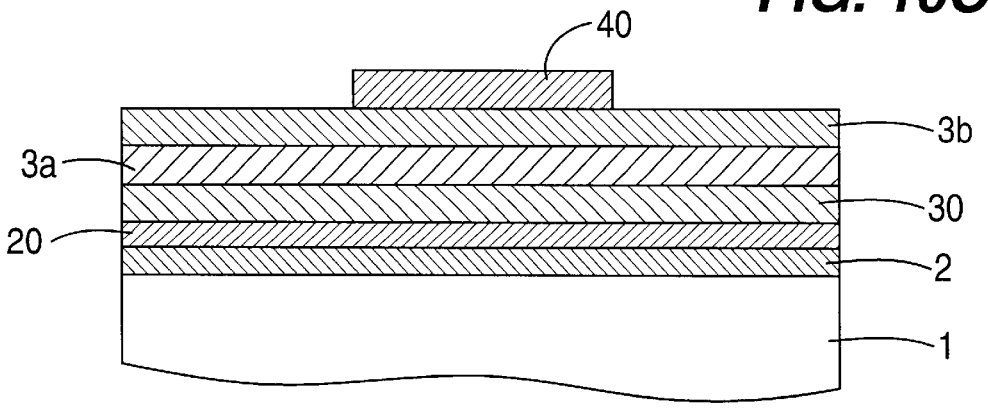

As shown in FIGS. 10C and 10D, photoresist 60 is deposited on the second electrode 3*b*, and electrode pad 40 made of gold is deposited on the electrode pad area which is formed through the patterning process using photoresist 60. Preferably, electrode pad 40 is formed into a thickness within the range of approximately 0.41 $\mu$m to 0.8 $\mu$m, and more preferably about 0.6 $\mu$m.

Figure 10E:
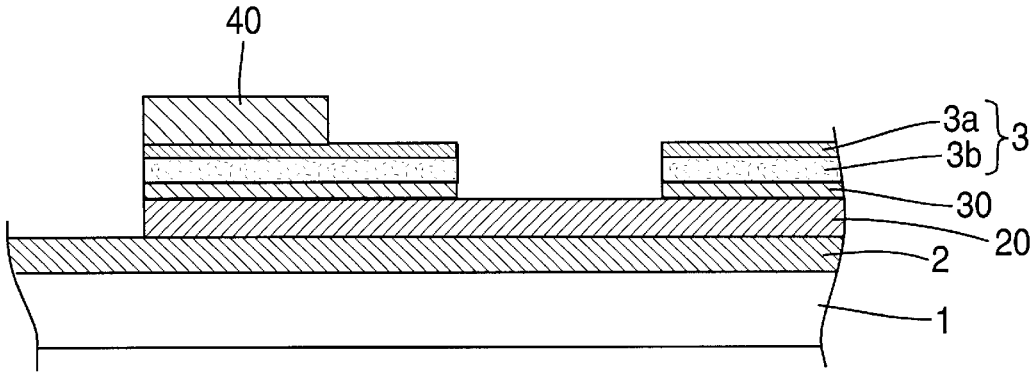

As shown in FIG. 10E, electrode 3, which is a layer, and adhesion layer 30 are patterned to the appropriate form through an etching process using photoresist 60. In a conventional method, if the etching process is performed so as to pattern electrode 3, adhesion structure between heater resistor layer 20 and electrode 3 is gradually destroyed due to chemical reaction. Thus, a gap is formed on the boundary surface between the two layers.

In practice of the present invention, however, adhesion layer 30 with excellent adhesion to both heater resistor layer 20 and electrode 3 is inserted onto the boundary surface between the two layers. As a result, adhesive structure between the two layers can be firmly maintained, and a gap will not be formed on the boundary surface even when the above-described etching process is performed.

Figure 10F:
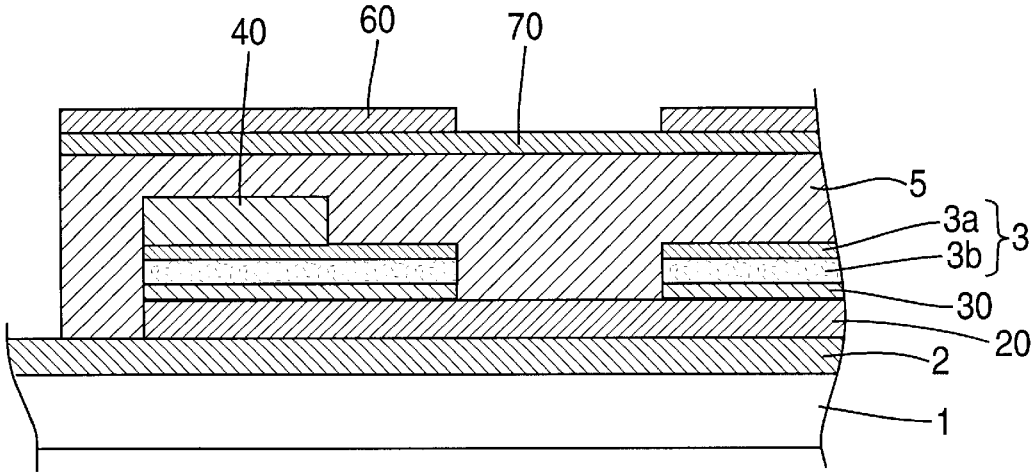

As shown in FIG. 10F, heater chamber barrier layer 5 made of polyimide is deposited on electrode pad 40 and second electrode 3*b*. Heater chamber barrier layer 5 so formed is removed by an etching process which will be explained later, and the heater chamber 4 is formed in the area where heater chamber barrier layer 5 is removed. Here, according to the characteristics of the present invention, heater chamber barrier layer 5 is deposited to a thickness within the range of approximately 10 $\mu$m to 15 $\mu$m, and more preferably about 13 $\mu$m. Here, according to the characteristics of the present invention, photoresist adhesion layer 70 for improving adhesion with photoresist 60 is deposited on heater chamber barrier layer 5. Photoresist adhesion layer 70 is formed into a single layer consisting of either chromium or copper, or a layer in which chromium and copper are deposited in turn.

In general, such metals are known to have excellent adhesion to photoresist. Therefore, photoresist 60 is deposited on photoresist adhesion layer 70 and removed by an etching process, for example, lithography, so that photoresist adhesion layer 70 can be patterned into an appropriate form.

Here, preferably, photoresist adhesion layer 70 is deposited to a thickness within the range of approximately 1.5 $\mu$m to 3 $\mu$m, and more preferably about 2 $\mu$m. In addition, the surface resistance of photoresist adhesion layer 70 stays within the range of approximately 180 $\Omega/cm^2$ to 220 $\Omega/cm^2$, and more preferably about 200 $\Omega/cm^2$.

Figure 10G:
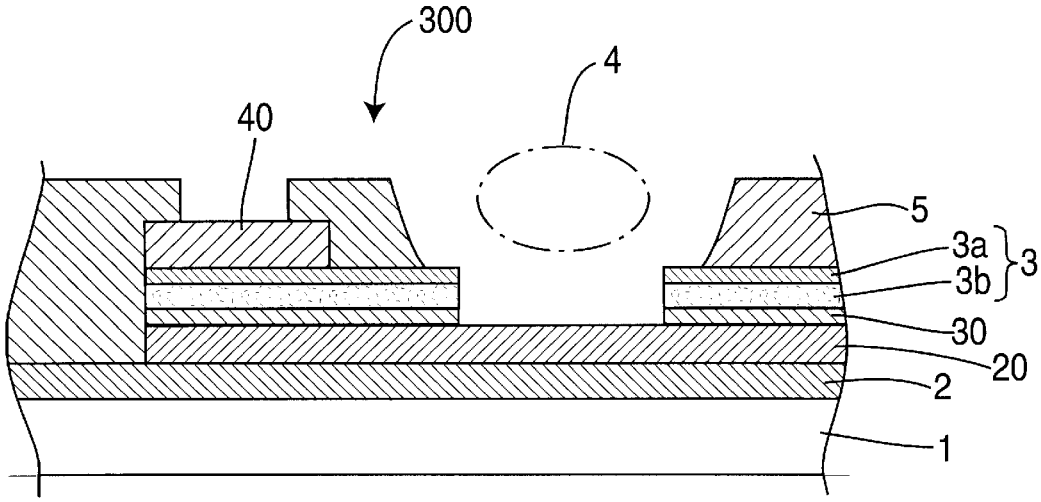

As shown in FIG. 10G, heater chamber barrier layer 5 is removed by an etching process, preferably an ion-plasma etching method, forming heater chamber 4. At this time, photoresist adhesion layer 70 which is patterned by photoresist 60 helps in etching heater chamber barrier layer 5. Then, residual photoresist adhesion layer 70 on heater chamber barrier layer 5 is completely removed by an etching process, preferably a chemical etching process. As a result, a heating apparatus of a microinjection device of the present invention is manufactured.

As described above, the present invention includes an adhesion layer for obtaining excellent adhesion between a heater resistor layer and an electrode, formed as a layer, so that the adhesive structure between the two layers can be strongly maintained. This invention serves to resist formation of a gap which may be formed on the boundary surface between the two layers, thereby significantly improving microinjection device performance.

Turning now to the methods of use of the present invention, the preferable use in an inkjet print head as shown in FIG. 2 has already been described. There are numerous designs, however, for thermal inkjet print heads in the contemporary art which might be improved by use of the micro-heater of the present invention as the heating element. The present invention is therefore of general utility as the heating element in inkjet print heads.

In addition to use in inkjet print heads, devices such as the one shown in FIG. 2 can be used more generally as micro-injection devices, by placing liquids other than ink in ink chamber 9 as a fluid chamber 9 defined by barrier layer 7 as a fluid chamber barrier layer 7 formed on membrane 6. For example, such a micro-injection device could be used to inject biologically active fluids, such as drugs, into a living organism. Such a device could be used to administer pharmaceuticals to a human or other mammal and could be worn on the skin or implanted in the body. Such a microinjection device could be used to deliver necessary fluids, such as fuels or lubricants, to machinery. For example, such a microinjection device might be incorporated into a machine to deliver lubricants to the machine.

In summary, in the present invention, an adhesion layer is formed between a heater resistor layer and an electrode so as to improve adhesion between the two layers. This serves to prevent formation of a gap between the two layers, thereby significantly improving the performance and lifespan of entire apparatus. This invention has been described above with reference to the aforementioned embodiments. It is evident, however, that many alternative modifications and variations will be apparent to those having skill in the art in light of the foregoing description. Accordingly, the present invention embraces all such alternative modifications and variations as fall within the spirit and scope of the appended claims.

What is claimed is:

1. A microinjection device for ejecting a fluid, comprising:

a substrate;

a protective film formed on said substrate;

a heater resistor layer formed on said protective film;

an adhesion layer formed on said heater resistor layer, said adhesion layer being formed of an electrically conductive material;

a first electrode formed as a layer on said adhesion layer;

a second electrode formed as a layer on said first electrode, said second electrode being formed as a layer without contacting said adhesion layer;

an electrode pad formed on said second electrode for receiving electrical energy for said microinjection device;

a heater chamber barrier layer formed on said second electrode, defining a heater chamber with an exposed portion of said heater resistor layer as a floor of said heater chamber;

a membrane formed on said heater chamber barrier layer spanning the top of said heater chamber;

a fluid chamber barrier layer formed on said membrane, defining a fluid chamber for a fluid; and a nozzle plate formed on said fluid chamber barrier layer, said nozzle plate containing a nozzle providing an opening from said fluid chamber to outside of said microinjection device.

2. The microinjection device of claim 1, further comprised of:

said heater resistor layer being made of $TiB_2$; and said adhesion layer being made of a metal selected from the group consisting of vanadium, chromium and nickel.

3. The microinjection device of claim 1, further comprised of said heater resistor layer being made of $TiB_2$.

4. The microinjection device of claim 1, further comprised of said adhesion layer being made of vanadium.

5. The microinjection device of claim 1, further comprised of said adhesion layer being made of chromium.

6. The microinjection device of claim 1, further comprised of said adhesion layer being made of nickel.

7. The microinjection device of claim 1, further comprised of said microinjection device being incorporated in a thermal ink-jet printhead.

8. The microinjection device of claim 1, further comprised of said microinjection device being a microinjection device for administering a biologically active fluid to a mammal.

9. The microinjection device of claim 1, further comprised of said microinjection device being a microinjection device for administering a fluid to a machine.

10. The microinjection device of claim 1, further comprised of said microinjection device being a microinjection device for administering a fluid to a living organism.

11. A method for fabricating a heating apparatus of a microinjection device, said method comprising the steps of:

forming a protection film on a substrate;

forming a heater resistor layer on said protection film;

depositing an adhesion layer on said heater resistor layer;

depositing a first electrode as a layer on said adhesion layer;

depositing a second electrode as a layer on said first electrode, said second electrode being deposited as a layer without contacting said adhesion layer;

depositing photoresist on said second electrode to define an electrode pad area;

forming an electrode pad on said second electrode in said electrode pad area for receiving electrical energy for said heating apparatus;

etching and patterning said adhesion layer, said first electrode and said second electrode to expose a region of said heater resistor layer; and forming a heater chamber barrier layer on said second electrode and patterning said heater chamber barrier layer so as to form a heater chamber, with said exposed region of said heater resistor layer forming a floor of said heater chamber.

12. The method for fabricating a heating apparatus according to claim 11, further comprised of said adhesion layer being deposited by a sputtering method upon said heater resistor layer.

13. The method for fabricating a heating apparatus according to claim 12, further comprised of said adhesion layer being formed to a thickness within the range of approximately 0.1 $\mu$m to 0.2 $\mu$m.

14. The method for fabricating a heating apparatus according to claim 12, further comprised of said adhesion layer being formed to a thickness of about 0.1 $\mu$m.

15. The method for fabricating a heating apparatus according to claim 11, further comprised of said adhesion layer having a surface resistance within a range of approximately 180 $\Omega/cm^2$ to 220 $\Omega/cm^2$.

16. The method for fabricating a heating apparatus according to claim 11, further comprised of said adhesion layer having a surface resistance of about 200 $\Omega/cm^2$.

17. The method for fabricating a heating apparatus according to claim 11, further comprised of said electrode pad being formed to a thickness within a range of approximately 0.4 $\mu$m to 0.8 $\mu$m.

18. The method for fabricating a heating apparatus according to claim 11, further comprised of said electrode pad being formed to a thickness of about 0.6 $\mu$m.

19. The method for fabricating a heating apparatus according to claim 11, further comprised of said heater chamber barrier layer being formed to a thickness within a range of 10 $\mu$m to 15 $\mu$m.

20. The method for fabricating a heating apparatus according to claim 11, further comprised of said heater chamber barrier layer being formed to a thickness of about 13 $\mu$m.

21. The method for fabricating a heating apparatus according to claim 11, further comprised of said heater chamber barrier layer being patterned by ion-plasma etching.

22. The method for fabricating a heating apparatus according to claim 11, further comprising the step of sequentially depositing a photoresist adhesion layer on said heater chamber barrier layer.

23. The method for fabricating a heating apparatus according to claim 22, further comprised of depositing said photoresist adhesion layer as a double layer by depositing a layer of chromium on said heater chamber barrier layer and then a layer of copper on said layer of chromium.

24. The method for fabricating a heating apparatus according to claim 22, further comprised of depositing said photoresist adhesion layer as a double layer by depositing a layer of copper on said heater chamber barrier layer and then a layer of chromium on said layer of copper.

25. The method for fabricating a heating apparatus according to claim 22, further comprised of said photoresist adhesion layer being a single layer made of chromium.

26. The method for fabricating a heating apparatus according to claim 22, further comprised of said photoresist adhesion layer being a single layer made of copper.

27. The method for fabricating a heating apparatus according to claim 22, further comprised of said photoresist adhesion layer being formed to a thickness within a range of approximately 1.5 $\mu$m to 3 $\mu$m.

28. The method for fabricating a heating apparatus according to claim 22, further comprised of said photoresist adhesion layer being formed to a thickness of about 2 $\mu$m.

29. The method for fabricating a heating apparatus according to claim 22, further comprised of said photoresist adhesion layer being removed by chemical etching.

30. The method for fabricating a heating apparatus according to claim 11, further comprised of fabricating said heating apparatus in a microinjection device for a thermal ink-jet printhead.

31. The method for fabricating a heating apparatus according to claim 11, further comprised of fabricating said heating apparatus in a microinjection device for administering a fluid to a living organism.

32. The method for fabricating a heating apparatus according to claim 11, further comprised of fabricating said heating apparatus in a microinjection device for administering a biologically active fluid to a mammal.

33. The method for fabricating a heating apparatus according to claim 11, further comprised of fabricating said heating apparatus in a microinjection device for administering a fluid to a machine.

34. A method of using a microinjection device, said microinjection device comprising a substrate, a protective film formed on said substrate, a heater resistor layer formed on said protective film, an adhesion layer formed on said heater resistor layer, said adhesion layer being formed of an electrically conductive material, a first electrode formed as a layer on said adhesion layer, a second electrode formed as a layer on said first electrode, said second electrode being formed as a layer without contacting said adhesion layer, an electrode pad formed on said second electrode for receiving electrical energy for said microinjection device, a heater chamber barrier layer formed on said second electrode, defining a heater chamber with an exposed portion of said heater resistor layer as a floor of said heater chamber, a membrane formed on said heater chamber barrier layer spanning the top of said heater chamber, a fluid chamber barrier layer formed on said membrane, defining a fluid chamber for a fluid, and a nozzle plate formed on said fluid chamber barrier layer, said nozzle plate containing a nozzle providing an opening from said fluid chamber to outside of said microinjection device, said method comprising the steps of:

applying electrical energy to said electrode pad on said second electrode;

transmitting said electrical energy to said heater resistor layer;

heating a working fluid in said heater chamber by said heater resistor layer converting said electrical energy to thermal energy;

vaporizing said working fluid by said thermal energy to form a vapor bubble in the working fluid in said working fluid chamber to provide a vapor pressure;

expanding said membrane formed on said heater chamber barrier layer by said vapor pressure to eject said fluid in said fluid chamber;

ejecting said fluid in said fluid chamber to outside of said microinjection device through said nozzle; and reducing irregularities in the vibration of said membrane by maintaining the presence of said adhesion layer.

35. The method of using a microinjection device of claim 34, further comprising the step of administering a biologically active fluid as said fluid in said fluid chamber ejected from said microinjection device to a mammal.

36. The method of using a microinjection device of claim 34, further comprising the step of administering said fluid in said fluid chamber ejected from said microinjection device to a machine.

37. The method of using a microinjection device of claim 34, further comprising the steps of:

incorporating said microinjection device in an ink-jet print head; and ejecting an ink as said fluid ejected from said microinjection device from said ink jet print head.

38. The method of using a microinjection device of claim 34, further comprising the step of administering a fluid as said fluid in said fluid chamber ejected from said microinjection device to a living organism.

* * * * *